United States Patent [19]

Schmid

[11] 4,341,335

[45] Jul. 27, 1982

[54] METHOD AND APPARATUS FOR CONTROLLING TENSION IN A MOVING MATERIAL

[75] Inventor: Franz J. Schmid, Moore, S.C.

[73] Assignee: Sistig Corporation, Spartanburg, S.C.

[21] Appl. No.: 194,754

[22] Filed: Oct. 7, 1980

[51] Int. Cl.[3] ..... B65H 23/08; B65H 59/00

[52] U.S. Cl. ..... 226/195; 242/75.5; 242/75.53

[58] Field of Search ..... 226/195, 41, 40, 42, 226/25; 242/95.51, 75.5, 75.52, 75, 53

[56] References Cited

U.S. PATENT DOCUMENTS

| | | | |
|---|---|---|---|
| 1,275,636 | 8/1918 | Wenderhold | 248/189 |
| 1,692,955 | 11/1928 | Rowley | 226/2 |
| 1,886,342 | 11/1932 | Koch | 260/16 |
| 2,029,854 | 2/1936 | Connity | 226/41 |
| 2,301,249 | 11/1942 | Butterworth | 34/52 |
| 2,570,773 | 10/1951 | Davis | 226/195 X |
| 2,637,991 | 5/1953 | Cohn | 68/20 |
| 2,739,762 | 3/1956 | Cohn | 242/75.5 |
| 2,759,728 | 8/1956 | Huck | 271/2.3 |
| 2,787,463 | 4/1957 | Huck | 271/2.3 |
| 2,847,210 | 8/1957 | Halley | 271/2.3 |
| 2,897,754 | 8/1959 | Spiller | 101/180 |
| 2,914,266 | 11/1959 | Connell | 242/55.14 |
| 3,043,535 | 7/1962 | Chittenden | 242/75.53 |
| 3,083,887 | 4/1963 | Huck | 226/41 |
| 3,167,265 | 1/1965 | Thau | 242/55.12 |
| 3,180,548 | 4/1965 | Stafford | 226/195 |
| 3,326,436 | 6/1967 | Huck | 226/25 |
| 3,771,744 | 11/1973 | Yastrebov | 242/75.53 |

*Primary Examiner*—Edward J. McCarthy
*Attorney, Agent, or Firm*—Luke J. Wilburn, Jr.; Wellington M. Manning, Jr.

[57] ABSTRACT

Method and apparatus for controlling tension in a longitudinally moving web between fixed material feeding points while maintaining the length of the path of web movement between said fixed points substantially constant. Two axially fixed, web-feeding rollers are positively driven from a common drive motor. One roller is driven at a variable speed through a shaft-mounted transmission unit having a variable pitch pulley spaced from the axis of rotation of the roller shaft and connected to the motor by a flexible belt. Fluid piston means provides a constant force on the transmission unit in a direction about the roller shaft axis to impose a constant torque on the variable speed roller and to move the variable pitch pulley to increase or decrease the speed of the roller, thereby maintaining a constant imposed tension on the material in its path of movement between the two rollers.

In a further embodiment, web tension variations upstream of the two feed rollers is controlled by an upstream displaceable roller which moves in response to upstream tension variations in the web to move the transmission unit about the feed roller shaft axis and vary the speed of the feed roller to maintain a substantially constant total tension on the web in its path of movement between the two feed rollers.

19 Claims, 3 Drawing Figures

METHOD AND APPARATUS FOR CONTROLLING TENSION IN A MOVING MATERIAL

This invention relates to a tension control device, and more particularly, to a device for setting and controlling tension in a longitudinally moving web or strand of material. In one embodiment, the tension control device comprises means for setting and maintaining a substantially constant imposed tension on a positively fed moving web or strand between fixed points in its path of movement. In a further embodiment, the device includes means for setting and maintaining a substantially constant total tension of desired magnitude in the moving length of material between fixed points in its path of movement.

BACKGROUND OF THE INVENTION

In the handling and treatment of certain moving indefinite length materials, it is desirable and often essential that tension on the moving material between points in its longitudinal path of travel be controlled and/or maintained at a substantially constant level. When materials of an elastic nature, such as textile fabrics and yarns, are longitudinally conveyed under tension between fixed feeding points for the material, the materials may irregularly stretch or contract in length due to treatments applied thereto or as a result of structural irregularities which may be present along the length of the material itself. Such factors can create variations in tension in the material between the fixed feeding points and can result in non-uniform treatment of the materials. For example, when a textile pile fabric, such as a carpet is subjected to a bushing operation to raise the pile components of the fabric prior to a shearing operation, it is desirable that the moving fabric be under substantially constant pressure contact with the bushing means to ensure uniform raising of the pile surface. Similarly, in heat treatment of certain moving materials, such as textile fabrics and yarns, substantially constant tension is necessary to control shrinkage or stretching of the materials during the treating operation.

It is a conventional practice in such material handling operations to provide control devices for maintaining a desired tension on the moving material in portions of its path of travel. Typically, such tension control devices comprise displaceable material guiding rollers, commonly referred to as floating rollers or dancer rollers, which are positioned to engage the material in its path of travel between fixed material-feeding points. The movable guide rollers are displaced in response to an increase or decrease in the length of the material caused by tension variations, and their movement signals a change in speed of one of the feeding rollers to adjust tension to the desired level. Certain other displaceable roller tension control devices are operatively connected to pneumatic piston means which exerts a predetermined force or pressure on the roller to move the same and increase or decrease the length of the material path, thereby maintaining a substantially constant tension on the material. U.S. Pat. Nos. 3,083,887 and 3,326,436 illustrate tension control devices of the floating or dancer roller type.

Other tension control devices employ axially displaceable, driven feed rollers which are displaced by tension variations in the material, with such displacement operating to proportionally vary the speed of the feed rollers through variable speed transmission arrangements to return the tension to a desired level. U.S. Pat. No. 2,787,463 discloses a web tension control mechanism comprising a pair of positively driven web feeding rollers mounted for movement in a linear direction in response to variations in tension in the web. The rollers are driven by a variable-pitch pulley and belt drive arrangement, and an adjustable spring mechanism is employed to establish a desired pressure against displacement of the rollers in one direction. Any variation in tension in the web displaces the driven feed rollers to cause corresponding displacement of the pulley belt on the variable pitch pulley to increase or decrease the speed of the rollers and maintain a substantially uniform tension on the material.

U.S. Pat. No. 2,759,728 discloses a tension control system wherein a pair of feed rollers for moving a web of material are mounted for displacement on a lever arm having a spring biasing arrangement. Variation in tension in the web against the force of the spring causes corresponding displacement of the driven rollers to vary the position of a roller drive belt on a variable-pitch drive pulley which correspondingly varies the speed of the rollers to maintain the tension on the web at the desired level.

Other tension control devices employing variable-speed drive motors, variable-pitch drive pulley arrangements, or floating roller tension sensing devices are disclosed in the following U.S. Pat. Nos. 1,275,636; 1,692,955; 1,886,342; 2,029,854; 2,301,249; 2,637,991; 2,847,210; 2,897,754; 2,914,266; 3,167,265; and 3,771,744.

Generally such tension control devices as described in the aforementioned patents which require axial displacement of material feed or dancer roller arrangements to sense and compensate for tension variations in the material path not only add to the cost of the material handling equipment, but also require additional space to allow for lengthening and shortening of the material handling path. Such arrangements, because they require changes in the length of the path of the material between fixed points along the path to sense and/or correct variations in tension, are often undesirable, particularly where the material between fixed material feeding points must be in a precise position of contact with a material treating device, such as a brush or a knife coating blade, or where portions of the moving material must be exposed to multiple treating operations at precisely timed intervals.

OBJECTS OF THE PRESENT INVENTION

It is therefore an object of the present invention to provide a tension control device for maintaining a substantially constant imposed tension on a moving material between fixed material feeding points or rollers without changing the material path length or direction between the fixed feeding points.

It is another object to provide an improved tension control device of economical and simplified construction, and which may be employed with a common motor for driving material feeding rollers located at fixed positions along the web path.

It is another object to provide a tension control device for maintaining a constant imposed tension in a moving material between fixed points along its path of travel without the use of sensing devices which must engage and displace the path of material movement between the fixed points.

It is still another object to provide an improved tension device for imposing and maintaining a substantially constant total tension of desired magnitude on a continuously moving material in a portion of its path of travel, regardless of variations in tension which may occur in or upstream of the path portion being controlled.

It is a more specific object to provide a tension control device for imparting a desired imposed tension on a moving web or strand of material by applying and maintaining a constant torque on a fixed position, rotatable feeding roller of the system.

It is another object to provide an improved method of controlling tension in a moving length of material between fixed feeding points along the path of movement of the material.

BRIEF SUMMARY OF THE INVENTION

Briefly, the present invention in a first embodiment thereof is directed to a tension control device for imposing and maintaining a desired tension in a longitudinally moving web or strand of material by maintaining a constant torque on a positively driven material-feeding roller of the material conveying system, and without the necessity of contacting the material or varying the length or direction of its path in the portion of the path in which tension is controlled. The tension control device includes a pair of axially fixed, rotatably driven rollers for conveying a material in a desired path of travel therebetween. The rollers are preferably driven by a common drive motor, with one of the rollers being driven at a preselected constant rate of speed while the speed of the other roller is varied in response to irregular contraction or extension in the length of the material between the feeding rollers by application and maintenance of a constant torque on the variable speed roller. More specifically, the variable speed roller is rotatably driven by shaft-mounted transmission means, such as a speed reduction gear unit having a variable-pitch drive pulley mounted thereon at a radially spaced distance from the roller shaft axis. The variable-pitch pulley is connected by a pulley belt to the common drive motor and constant pressure means, such as a pneumatic piston is attached to the transmission means to adjustably position the same about the axis of rotation of the shaft while maintaining a constant torque on the roller, thus maintaining a constant imposed tension on the web or strand being fed by the roller.

In a further embodiment of the invention, the aforementioned tension control device is employed in combination with a displaceable roller arrangement located in the material path immediately upstream of the axially fixed feeding rollers to provide a desired substantially constant total tension in the material path between the rollers, regardless of tension variations which may occur upstream of the feeding rollers.

BRIEF DESCRIPTION OF THE DRAWINGS

The above as well as other objects of the invention will become more apparent, and the invention will be better understood, from the following detailed description of preferred embodiments thereof, when taken together with the accompanying drawings, in which.

DETAILED DESCRIPTION OF PREFERRED EMBODIMENTS

Figure 1:
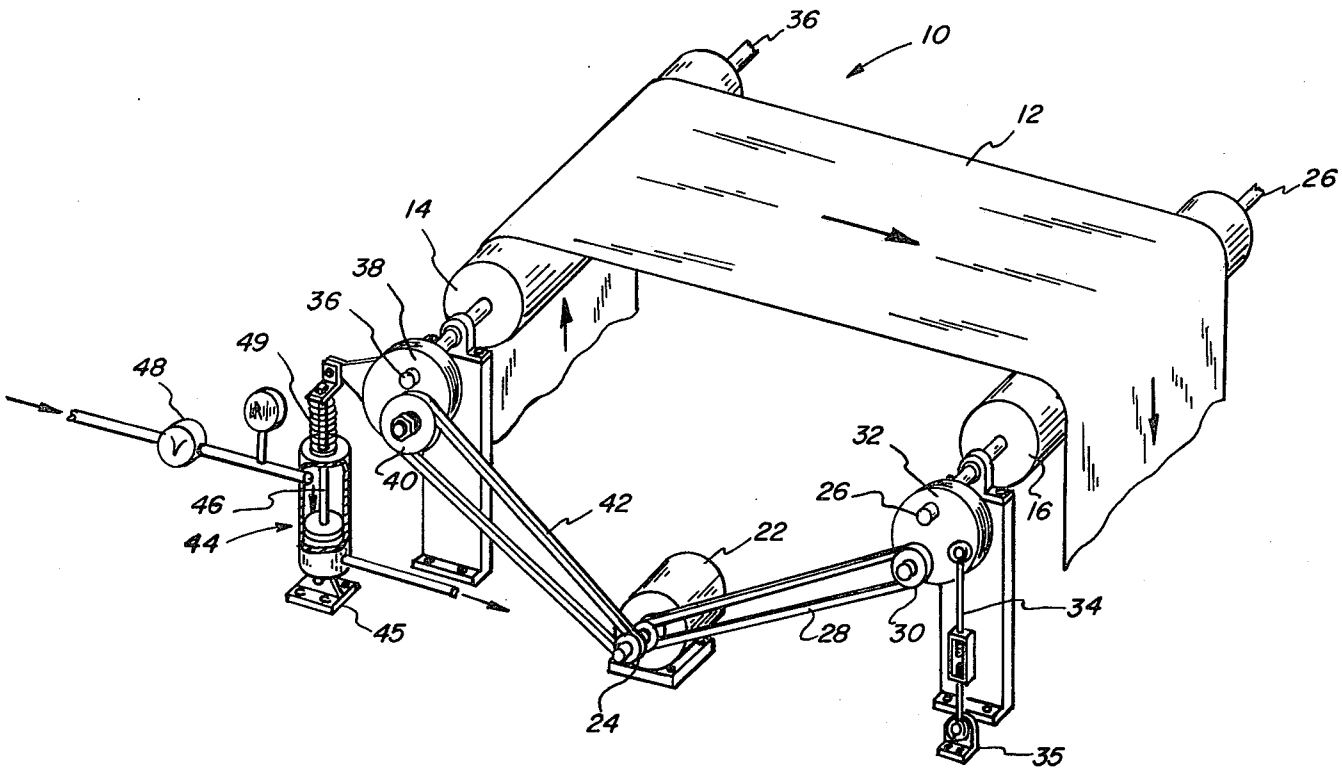
FIG. 1 is a schematic perspective view of a web or strand conveying system incorporating a first embodiment of tension control means of the present invention to maintain a substantially constant imposed tension on the material in a portion of its path of travel.

Referring more particularly to the drawings, FIG. 1 illustrates a web or strand conveying device 10 for longitudinally feeding an indefinite length material, such as a textile fabric 12, in a desired path of travel between two axially fixed, positively driven feed rollers 14, 16. As shown, the material-engaging surfaces of the feed rollers 14, 16 are constructed to positively frictionally grip and feed the web without slippage on the rollers, although additional freely rotatable rollers may be employed therewith, as in nip relation, if desired, to ensure that the web is positively fed by the rollers.

Although the path of travel of the fabric between the rollers 14, 16 is illustrated, for convenience, as a straight line in FIG. 1, the path direction and distance between the fixed position feed rollers may be varied by engagement with freely rotatable guide rolls, guide bars, or with fabric treating equipment located in the material path between the fixed feed rollers 14, 16.

Feed rollers 14, 16 are positively driven from a common power supply, shown as a D.C. electric motor 22, the output shaft of which is provided with a double-track pulley 24. Motor pulley 24 is drivingly connected to the drive shaft 26 of feed roller 16 by a flexible pulley belt 28, and a driven pulley 30 mounted on a shaft-mounted transmission means, or speed reduction unit 32. Such shaft-mounted speed reduction units are well known in the art, and may be of the type manufactured by Boston Optimount and described in U.S. Pat. No. 2,813,435. Reduction unit 32 is a helical gear, speed-reducer type and is supportably mounted on drive shaft 26 and fixed against rotation about the shaft by an adjustable rod 34, one end of which is attached to the gear unit housing and the other end of which is fixed to fixed support member 35 of the web handling device. Adjustable rod 34 is employed to permit tensioning of the pulley belt 28 on the pulleys 26, 30 to ensure positive driving connection therebetween.

Figure 2:
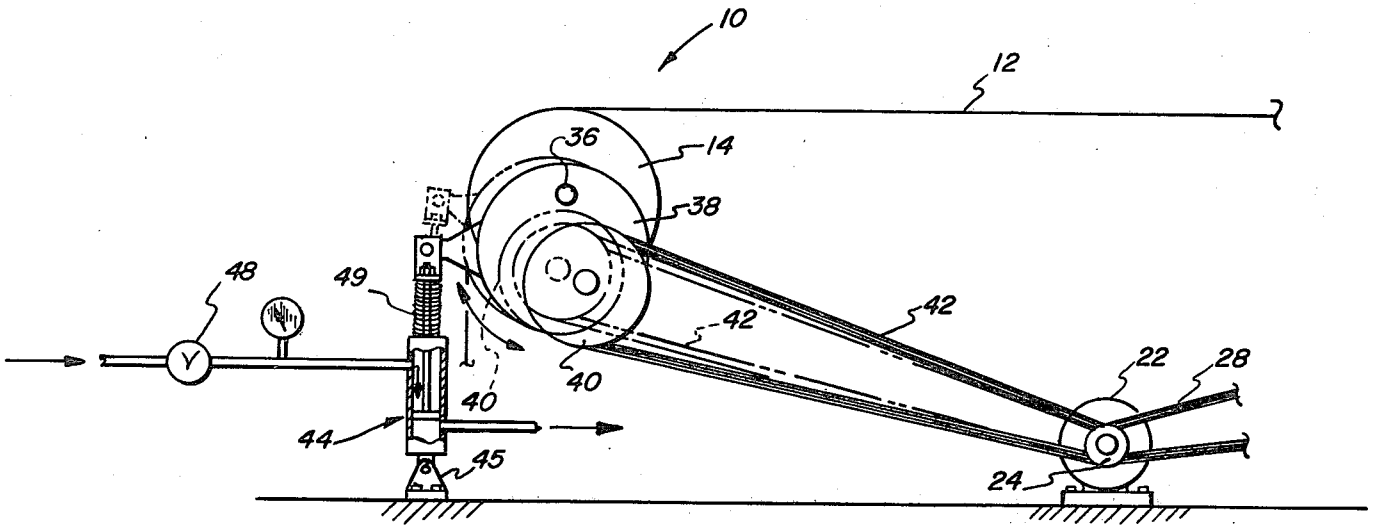
FIG. 2 is an enlarged schematic side elevation view of the first feed roller of FIG. 1, more clearly showing the manner in which a constant torque is applied to and maintained on the roller during the material conveying operation.

Supportably mounted on a drive shaft 36 of rotatable feed roller 14 to impart rotation thereto is a second power transmission means, or speed reduction unit 38 of the same type as reduction unit 32. Supported on and drivingly connected to reduction unit 38 is a variable-pitch pulley 40, which is located on unit 38 at a radially spaced distance from the axis of rotation of drive shaft 36. Variable-pitch pulley 40 is connected to the other track of motor pulley 24 by a flexible pulley belt 42. Variable-pitch drive pulleys are well known in the art, and may be of the spring-loaded sheave type manufactured by T. B. Wood's Sons Co. of Chambersburg, Pa. Variable pitch pulley 40 provides variable speed output from fixed speed output motor 22 in response to changes in the distance between variable pitch pulley 40 and motor drive pulley 24, which positions the belt 42 at a different diameter on the variable-pitch pulley, as is illustrated in FIG. 2 of the drawings.

Such an arrangement as so far described in reference to FIG. 1 has been employed in web conveying systems of the prior art, with the position of both gear reduction units being fixed by an adjustable rod, such as rod 34, to prevent rotation of the reduction units about the feed roller drive shafts and permit positioning of the variable pitch pulley 40 on reduction unit 38 at a desired distance from motor pulley 24 to set a desired speed ratio between the two driven rollers 14, 16 of the web handling system.

The first embodiment of the tension control device of the present invention, in the material conveying system described, includes the provision of constant pressure means, shown as a pneumatic piston 44, the cylinder of which is pivotally attached to a fixed support 45 of the web handling device, and the piston rod 46 of which is attached to gear reduction unit 38 at a radially spaced distance from the axis of rotation of drive shaft 36 on which the unit 38 is mounted. In the arrangement shown in FIGS. 1 and 2, the pneumatic piston is a single-acting piston with air pressure being supplied from a supply source (not shown) through a pressure regulator valve 48 which is adjustably set to apply and maintain a desired constant force on the reduction unit in a counterclockwise direction and at a spaced distance from the axis of feed roller drive shaft 36, thus imposing a constant torque on the feed roller 14 acting in a direction opposite to the direction of rotation of the feed roller 14.

Surrounding the piston rod 46 is a compression spring 49 which maintains a desired counter-pressure, in clockwise direction, on gear reduction unit 38 to counterbalance the normal running tension force of the pulley belt 42 on the variable-pitch pulley 40.

The operation of the tension control device shown in FIGS. 1 and 2 may be described as follows. The continuous length web of textile fabric 12 is supplied to the first positively driven feed roller 14 from a suitable supply source, such as a delivery roll (not shown) and is positively fed thereby to the second positively driven feed roller 16. Second feed roller 16 is driven at a desired constant rate of speed from the common drive motor 22 by way of drive belt 28, pulley 30 and shaft-mounted gear reduction unit 32. Feed roller 14 is correspondingly driven at a selected rate of speed, relative to the speed of roller 16, through drive belt 42, variable-pitch pulley 40 and reduction unit 38, to impose and maintain a desired tension on the fabric between the feed rollers. To accomplish this, pressurized air is supplied to the pneumatic piston 44 by way of pressure regulator valve 48, and the valve is set to apply and maintain a desired constant force in the piston which acts in a counterclockwise direction on the gear reduction unit 38. The force thus applied imposes in a constant torque on the roller 14 which correspondingly imposes a proportional constant imposed tension on the length of the fabric passing between rollers 14, 16.

Any slight contraction or extension of the fabric which may occur in the fabric path between the feed rollers 14, 16 due to fabric irregularities or irregular stretching or contracting of the same, will result in corresponding movement of the reduction unit 38 about the axis of drive shaft 36, due to the constant force being applied thereto by the pneumatic piston 44. Such reduction unit movement correspondingly shortens or lengthens the distance between motor pulley 24 and variable-pitch pulley 40 to position belt 42 at a different diameter on the variable-pitch pulley, as illustrated in broken lines in FIG. 2, thereby increasing or decreasing the speed of the roller 14 to immediately compensate for the length change in the fabric. Such action results in a balance between the forces of tension on the fabric web, constant pneumatic force on the reduction unit, and the position of the pulley belt on the variable-pitch pulley to maintain a constant imposed tension on the fabric set by the constant torque on roller 14.

Although the constant torque on the drive roller 14 is applied by use of a pneumatic piston, other constant pressure devices, such as springs or the like, may be employed for this purpose. In lieu of the compression spring 49 shown in FIG. 1 to offset normal running tension on the pulley belt 42, a double-acting pneumatic piston may be employed, with the offsetting force of the compression spring being achieved by maintaining a desired constant counter-pressure on the lower side of the piston head of the piston.

The tension control device as shown in FIGS. 1 and 2 maintains a constant imposed tension of desired magnitude on the fabric web between the positively driven feed rollers, and such a device is completely satisfactory for uniform tension control between fixed feeding rollers when tension variations on the web upstream of the rollers 14, 16 are negligible, or when other tension control devices located in the web handling system upstream of rollers 14, 16 are employed for this purpose.

Figure 3:
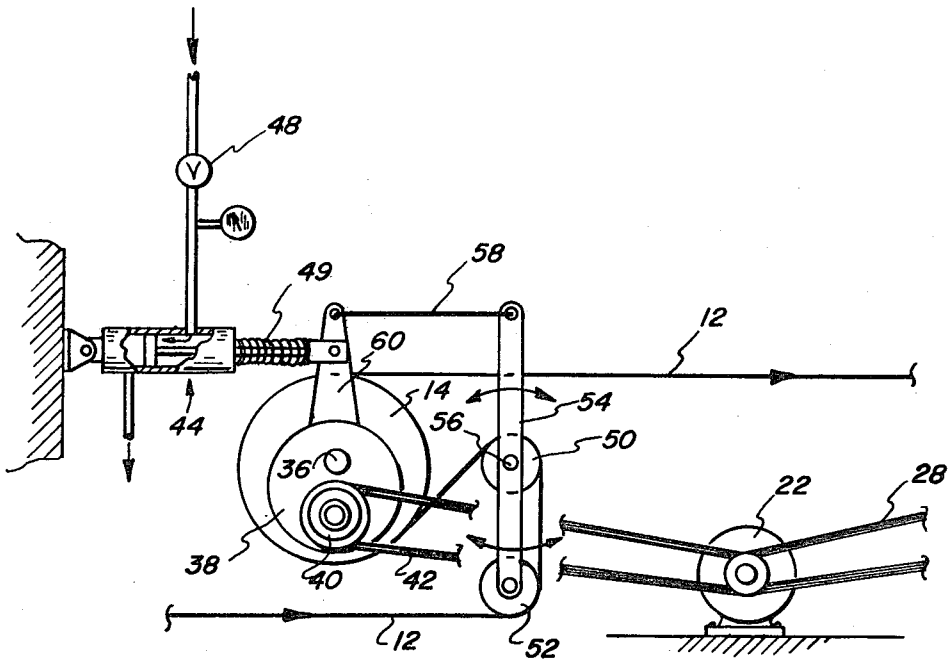
FIG. 3 is an enlarged schematic side elevation view of the first feed roller of a material conveying system as shown in FIG. 1, illustrating a second embodiment of the invention wherein further tension control means are employed in combination with the tension control device of FIG. 1 to maintain a substantially constant total tension of desired magnitude in a web or strand of material between fixed material feeding points, regardless of variations in web tension which may occur in the upstream path of the web.

FIG. 3 shows a second embodiment of tension control device of the present invention which may be employed where fabric web tension variations upstream of the fixed feeding rollers 14, 16 are not controlled, and are of sufficient significance to change or undesirably affect the level of tension on the web between feed rollers 14 and 16. As seen in FIG. 3, positioned in the path of movement of the fabric web 12 to the first positively driven feed roller 14 are freely rotatable guide rollers 50, 52 which are supportably mounted at the pivot point and at one end of a pivot arm 54, respectively. Pivot arm 54 is pivotally mounted on a suitable support shaft 56, the pivotal axis of which coincides with the rotational axis of roller 50. An elongate push rod 58 is pivotally attached to the other end of pivot arm 54 and to a fixed radial arm 60 of shaft-mounted gear reduction unit 38 of feed roller 14. Also attached to arm 60 of gear reduction unit 38 is the constant pressure pneumatic piston device 44 of FIG. 1. Variable-pitch pulley 40 on reduction unit 38 is connected to and driven by motor 22, in the same manner as in FIG. 1.

As can be understood from reference to FIG. 3, any variations in tension occurring in the fabric web 12 on the upstream side of positively driven feed roller 14 will cause pivotal displacement of pivot arm 54 and impart an oppositely directed force to the shaft-mounted reduction unit 38 to move the same and variable-pitch pulley 40 about the shaft 36 of feed roller 14. Movement of variable pitch pulley 40 toward or away from motor drive pulley 24 will change the position of belt 42 on pulley 40 to proportionately increase or decrease the speed of feed roller 14 and offset any upstream web tension variations which otherwise would pass into and be superimposed on the tension imposed on the web between feed rollers 14 and 16 by constant pressure piston 44.

By use of the modified form of tension control device shown in FIG. 3, it can be seen that the preselected torque imposed on the roller 14 by piston 44 will result in a desired constant total tension on the web between roller 14 and 16 equal to the imposed torque and any tension variations in the web occurring upstream of rollers 14, 16 will be prevented from passing into the material path between the positively driven feed rollers 14 and 16.

That which is claimed is:

1. Apparatus for longitudinally conveying an indefinite length of material in a desired path of travel while imposing a desired constant tension thereon comprising:

first and second positively driven feed rollers located in axially fixed, spaced relation to engage and convey the material in a path of fixed length therebetween, means for rotatably driving said rollers at desired rates of speed, and constant pressure means associated with said roller driving means for imparting a constant torque to one of said rollers to impose a corresponding tension on said material in its path between said rollers and to increase or decrease the speed of rotation of said one roller in response to longitudinal contraction or extension of the material in its fixed length path between said rollers.

2. Apparatus for longitudinally conveying an indefinite length of material in a desired path of travel while imposing and maintaining a substantially constant imposed tension thereon in said path comprising first and second axially fixed roller means located in spaced relation to define a fixed length path of movement of the material and for supportably engaging and conveying the material therebetween; motor means for positively driving said roller means to convey the material; first means interconnecting said motor means to one of said roller means to rotate the same at a desired rate of speed, and second means interconnecting said motor means to the other roller means to rotate the same, and including means for applying a constant force to said other roller means in a direction opposite its direction of rotation to automatically vary the rate of speed of said other roller means in response to longitudinal contraction or extension of the material in the fixed length path and maintain a substantially constant imposed tension on the material in its path of travel between said first and second roller means.

3. Apparatus as defined in claim 2 wherein said motor means includes a common motor for driving said first and second roller means, said other roller means includes a roller supportably engaging the surface of the indefinite length of material, and a drive shaft for rotating said roller; and wherein said second interconnecting means comprise transmission means supportably mounted on said roller drive shaft for imparting rotation thereto and for relative movement about the axis of the drive shaft, a drive pulley on said motor means, a variable-pitch pulley mounted on said transmission means in radially spaced relation from the axis of said roller drive shaft and interconnected therewith by said transmission means to impart rotation thereto, a flexible belt drivingly interconnecting said variable-pitch and motor pulleys, and wherein said force applying means is operatively attached to said transmission means for applying a constant force to said transmission means in a direction about said drive shaft while permitting movement of the transmission means and variable pitch pulley about said roller drive shaft in response to longitudinal extension and contraction of the material in its path of travel between said first and second roller means.

4. Apparatus as defined in claim 3 wherein said constant force applying means comprises fluid actuated piston means attached to said transmission means at a point radially spaced from said drive shaft for applying a selected constant force thereto to automatically adjust the angular position of said transmission means and variable-pitch pulley about the axis of rotation of said drive shaft in response to longitudinal extension or contraction of the material between said first and second roller means and thereby correspondingly increase or decrease the speed of rotation of said roller to compensate for such extension or contraction.

5. Apparatus as defined in claim 4 wherein said piston means includes means for applying a substantially constant second force to said transmission means in a direction opposite said first constant force direction to equalize the normal driving tension of said pulley belt on said variable pitch pulley.

6. Apparatus as defined in claim 5 wherein said oppositely directed constant force applying means comprises spring means operatively associated with said piston means and transmission means.

7. Apparatus as defined in claim 3 including means engaging said material in its path of its travel upstream of said roller and being displaceable in response to variations in tension in the material in said upstream path to impart a corresponding force to move said transmission means about the roller shaft axis and increase or decrease the distance between said variable pitch drive pulley and said motor drive pulley, thereby increasing or decreasing the speed of rotation of said roller to maintain a substantially constant total tension on said material in the path of movement between said first and second roller means which is equal to said imposed tension applied thereto by said constant force applying means.

8. Apparatus as defined in claim 7 wherein said means engaging the moving material upstream of said roller comprises freely rotatable roller means engaging the material and supportably mounted for displacement on one end of an elongate pivot arm having a central pivot point, and means operatively connecting the other end of said pivot arm to said transmission means to impart a force thereto in response to displacement of said freely rotatable roller means to move said variable-pitch pulley and correspondingly increase or decrease the speed of said roller.

9. Apparatus for longitudinally conveying an indefinite length of material in a desired path of travel while imposing and maintaining a substantially constant imposed tension thereon in said path, comprising first and second axially fixed material feeding rollers located in spaced relation for engaging and longitudinally conveying the material in a path of fixed length therebetween, common motor means for positively driving said rollers at desired rates of speed to convey the material in said fixed path length therebetween, and means for imposing and maintaining a constant torque on one of said rollers to impose a substantially constant imposed tension on the material in its fixed length path of movement between the rollers.

10. Apparatus as defined in claim 9 wherein said means for imposing and maintaining constant torque on said one of said rollers includes transmission means supportably mounted on a drive shaft of said one of said rollers and connected to said motor means for transmitting rotation to said drive shaft and for movement about the axis of rotation of said shaft, and means for applying a constant force of desired magnitude to said transmission means at a point radially spaced from and in a direction generally parallel to the axis of rotation of said roller shaft.

11. Apparatus as defined in claim 10 wherein said motor means comprises a motor having a drive pulley, a variable pitch pulley mounted on said transmission means at a radially spaced distance from the axis of rotation of said roller shaft, a flexible pulley belt connecting said motor pulley to said variable pitch pulley, and wherein movement of said transmission means about the axis of rotation of said shaft in response to said constant force means increases or decreases the distance between said motor pulley and variable pitch pulley to correspondingly increase or decrease the speed of rotation of said one roller.

12. Apparatus for longitudinally conveying an indefinite length of material in a desired path of travel while controlling tension on the material in said path, comprising:

first and second axially fixed, material feeding rollers located in spaced relation for engaging and longitudinally conveying the material in a path of movement therebetween;

motor means for positively driving said rollers at desired rates of speed and including a motor drive pulley;

a drive shaft for one of said rollers, transmission means supportably mounted on said drive shaft for transmitting rotation thereto and for movement about the axis of rotation of said drive shaft, a variable-pitch pulley drivingly connected to and supportably mounted on said transmission means at a radially spaced distance from the axis of rotation of said drive shaft for movement with said transmission means about said axis; a pulley belt connecting said variable-pitch pulley and said motor drive pulley, and means attached to said transmission means at a point radially spaced from the axis of rotation of said drive shaft for applying a constant force of desired magnitude to said transmission means to impose a corresponding torque on said one roller in a direction opposite its rotation, and to move said transmission means about the drive shaft axis in response to longitudinal contraction or extension of the material in said path to increase or decrease the distance between said motor drive pulley and said variable pitch pulley and correspondingly increase or decrease the speed of rotation of said one roller.

13. Apparatus as defined in claim 12 wherein said motor means includes a common motor for driving said first and second axially fixed material feeding rollers.

14. Apparatus as defined in claim 12 wherein said means for applying a constant force to said transmission means comprises fluid actuated piston means, and fluid pressure regulator means for setting and maintaining a desired constant fluid pressure in said piston means during conveyance of material between said first and second axially fixed feed rollers.

15. Apparatus as defined in claim 14 including means associated with said fluid actuated piston means for applying a substantially constant pressure to said transmission means in a direction opposite the direction of force applied thereto by said fluid actuated piston means to counteract the force of tension exerted thereon by said pulley belt.

16. Apparatus as defined in claim 14 including means engaging the material in its path of travel upstream of said axially fixed material feeding rollers and mounted for displacement in response to variations in tension in the material in said upstream path to impart a corresponding force to move said transmission means about said roller shaft axis and correspondingly increase or decrease the speed of rotation of said one roller to maintain a substantially constant total tension on said material in the path of movement between said first and second rollers.

17. Apparatus as defined in claim 16 wherein said means engaging the moving material upstream of said feeding rollers comprises freely rotatable roller means supportably mounted on an end portion of an elongate pivot arm having a central pivot point, and means operatively connecting the other end portion of said pivot arm to said transmission to impart a force thereto in a direction opposite the direction of displacement of said roller means by tension variations occurring in the upstream path of the material.

18. A method of longitudinally conveying an indefinite length of material in a desired path of travel while controlling tension thereon in a fixed length portion of the path comprising the steps of positively engaging and conveying the material with a pair of positively driven, axially fixed feeding rollers spaced along the path and defining end points of said fixed path length, rotatably driving said rollers while applying a constant torque to one of said rollers and while varying its rate of speed in response to contraction or extension of the material in said fixed length path to thereby impose a substantially constant tension on the material in said path.

19. A method of longitudinally conveying an indefinite length of material in a fixed length path of travel while imposing a substantially constant tension thereon, comprising the steps of (a) rotatably driving a pair of axially fixed, material feed rollers from a common drive motor with said rollers located in spaced relation to define a fixed length path of material movement therebetween, (b) imposing a constant torque on one of said rollers to impose a corresponding constant tension on the material in said fixed length path, and (c) automatically varying the rate of speed of said one roller in response to longitudinal contraction or extension of the material in said fixed length path to maintain said path length and said imposed tension on the material constant.

* * * * *